US006912985B2

(12) United States Patent
Gesell et al.

(10) Patent No.: US 6,912,985 B2
(45) Date of Patent: Jul. 5, 2005

(54) OIL DEFLECTOR APPARATUS

(75) Inventors: Fred Gesell, Sandusky, OH (US); Michael Blank, Rollingstone, MN (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/652,683

(22) Filed: Aug. 29, 2003

(65) Prior Publication Data

US 2004/0118373 A1 Jun. 24, 2004

Related U.S. Application Data

(60) Provisional application No. 60/434,509, filed on Dec. 18, 2002.

(51) Int. Cl.[7] ..... F01M 11/00

(52) U.S. Cl. ..... 123/195 A; 123/196 R; 264/328.1

(58) Field of Search ..... 123/195 A, 196 R; 184/6.5; 264/328.1

(56) References Cited

U.S. PATENT DOCUMENTS 4,345,552 A 8/1982 Kasting et al.
4,463,956 A 8/1984 Malott
4,471,731 A 9/1984 Kasting et al.
4,584,975 A 4/1986 Ohmi et al.
5,492,086 A 2/1996 Kuhns
5,937,817 A * 8/1999 Schanz et al. ..... 123/196 R
6,293,245 B1 9/2001 Bock
6,584,950 B1 * 7/2003 Cunningham ..... 123/195 C

* cited by examiner

*Primary Examiner*—Andrew M. Dolinar
(74) *Attorney, Agent, or Firm*—Leffert Jay & Polglaze, P.A.

(57) ABSTRACT

The oil deflector apparatus can be installed in an internal combustion engine to deflect oil from gaskets mounted between an upper deck assembly and the engine block. The apparatus has a first portion that extends lengthwise along the upper deck assembly and includes mounting holes that accept mounting hardware to couple the apparatus to the engine block. A second portion is coupled lengthwise along the first portion and is angled downward to cover any exposed surface of the gasket from the internal oil generated by the engine operation. Layshaft support extensions are distributed lengthwise along the apparatus to permit the apparatus to fit around the layshaft support hardware in the engine and to keep oil splashed from the layshaft from reaching the gasket.

13 Claims, 7 Drawing Sheets

OIL DEFLECTOR APPARATUS

RELATED APPLICATIONS

This application claims the benefit of U.S. Provisional Application No. 60/434,509, filed on Dec. 18, 2002, hereby incorporated herein in its entirety by reference.

TECHNICAL FIELD OF THE INVENTION

The present invention relates generally to internal combustion engines and in particular the present invention relates to directing the flow of oil in an internal combustion engine.

BACKGROUND OF THE INVENTION

One type of internal combustion engine is an overhead camshaft diesel engine that is commonly used in diesel-electric locomotives and in marine and power generation applications. This engine can be produced in a "V" configuration, where two banks of cylinder assemblies form the "V", or as a straight block where the cylinder assemblies are in a straight line.

Each bank of cylinder assemblies has an upper deck assembly that covers the cylinders. The upper deck assembly is typically comprised of metal that is formed to fit around the cylinders in addition to a cover that is connected to the top of the metal sides. The upper deck assembly is bolted to the engine block with a gasket between the upper deck sides and the engine block. The gasket prevents oil from within the engine from leaking out during normal operation.

Each bank of cylinder assemblies has at least one overhead camshaft comprised of cam lobes that engage followers on rocker arms as the layshaft rotates. This action can be used to actuate valve mechanisms and other mechanical devices.

To ensure proper operation of the layshafts, each camshaft is supplied with lubricating oil, as is each bearing through which the camshaft rotates. A portion of the lubricating oil comes from oil sprayed by various moving parts of the engine including the rocker arms and followers.

The gasket between the engine block and upper deck assembly cannot always keep oil from leaking out of the engine due to uneven clamping of the upper deck assembly to the engine block. Additionally, imperfections in the surface of the upper deck frame that forms one side of the gasket joint can allow oil out of the engine. This can result in damage to the engine from the oil on the exterior of the engine. There is a resulting need in the art to prevent oil from leaking out from between the upper deck assembly and the engine block.

SUMMARY

The embodiments of the present invention encompass an oil deflector apparatus. In one embodiment, the apparatus is used in an internal combustion engine having an engine block, an upper deck assembly, and a gasket between the engine block and the upper deck assembly. At least one surface of the gasket is internal to the engine.

A first portion of the apparatus extends lengthwise over the gasket. The first portion is capable of being coupled to the engine block. A second portion is coupled to and extends lengthwise along the first portion. The second portion is coupled to the first portion at an angle such that the surface of the gasket that is internal to the engine is substantially covered.

DETAILED DESCRIPTION

The upper deck oil deflector apparatus of the embodiments of the present invention deflects oil away from the gasket that is between the upper deck assembly and the engine block. The deflector substantially reduces the amount of oil that can leak out from between the upper deck assembly and the engine block.

Figure 1:
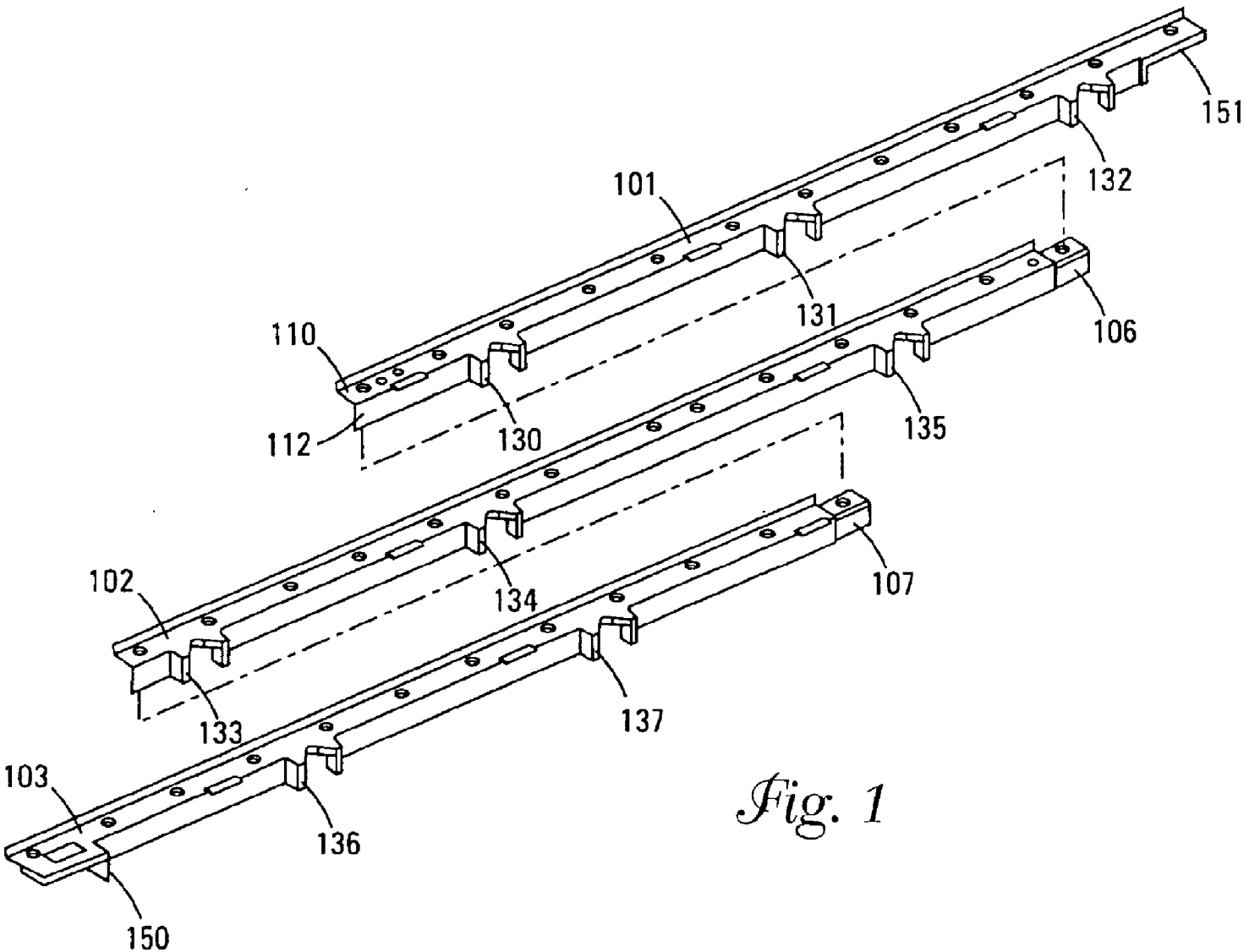
FIG. 1 shows an exploded view of one embodiment of the upper deck oil deflector apparatus of the present invention.

FIG. 1 illustrates an exploded view of one embodiment of the upper deck oil deflector apparatus of the present invention. This embodiment is comprised of three separate sections (101–103) that are connected together at the end (106 and 107) as described subsequently with reference to FIGS. 2 and 3. As will be seen in these figures, the end portions (106 and 107) have half the thickness of the rest of the section (101–103) so that when the end portions (106 and 107) are overlapped with the connecting sections, the entire thickness of the apparatus is substantially uniform.

Alternate embodiments are not limited to any predetermined quantity of sections or length of sections. For example, one embodiment may be only one section for the entire deflector apparatus. Additional embodiments may incorporate more or fewer than three sections.

The deflector apparatus, in one embodiment, is comprised of an injection molded polyurethane material. Alternate embodiments may use different materials and different manufacturing methods.

The deflector apparatus has a horizontally molded portion (110) that incorporates mounting holes through which mounting bolts or other types of fasteners can be inserted. These mounting holes are discussed subsequently in greater detail with reference to FIGS. 2 and 3.

A vertically molded portion (112) incorporates camshaft support extensions (130–137) that wrap around the camshaft bearing supports in the engine block. These extensions improve the oil deflection characteristics of the apparatus by keeping the oil sprayed from the camshaft bearing area from the gasket.

Since the deflector apparatus is injection molded, the horizontal (110) and vertical portions (112) are constructed as one unit. The layshaft support extensions (130–137) that are distributed lengthwise along the apparatus are also injection molded as one unit with the rest of the apparatus. However, alternate embodiments that use different manufacturing methods may construct each section (101—103) of the apparatus from separate portions (110 and 112). Additionally, the terms vertical and horizontal are used only for purposes of clarity in describing the apparatus. The two portions of the oil deflector apparatus of the embodiments of the present invention are not necessarily horizontal and vertical nor are they required to be orientated 90° to each other as illustrated in the embodiment of FIG. 1. The orientation of the lengthwise portions that comprise the deflector apparatus is determined by the engine configuration to which the apparatus is mounted. In alternate embodiments, the two lengthwise portions may be angled in a range between 0° and 180°.

In one embodiment, the two end sections (101 and 103) of the oil deflector apparatus have a short "L" portion incorporated at the outside end (150 and 151) of each section (101 and 103). This "L" portion extends up the side of each end of the upper deck assembly. Alternate embodiments may not incorporate this feature.

The embodiment illustrated in FIG. 1 does not have a symmetrical construction with regard to the mounting holes and the layshaft support extensions. The locations of these items are determined by the engine to which the deflector apparatus is mounted. Therefore, the present invention is not limited to any one configuration of mounting holes and layshaft support extensions. In fact, one embodiment may not even require the layshaft support extensions if the engine's layshaft is mounted far enough below the deflector apparatus so as not to interfere with the mounting of the apparatus over the gasket.

As described subsequently with reference to FIG. 5, a typical internal combustion engine uses two of the oil deflector apparatuses of the present invention. One deflector apparatus is installed over the gasket on the outside of each bank of cylinder assemblies.

Figure 2:
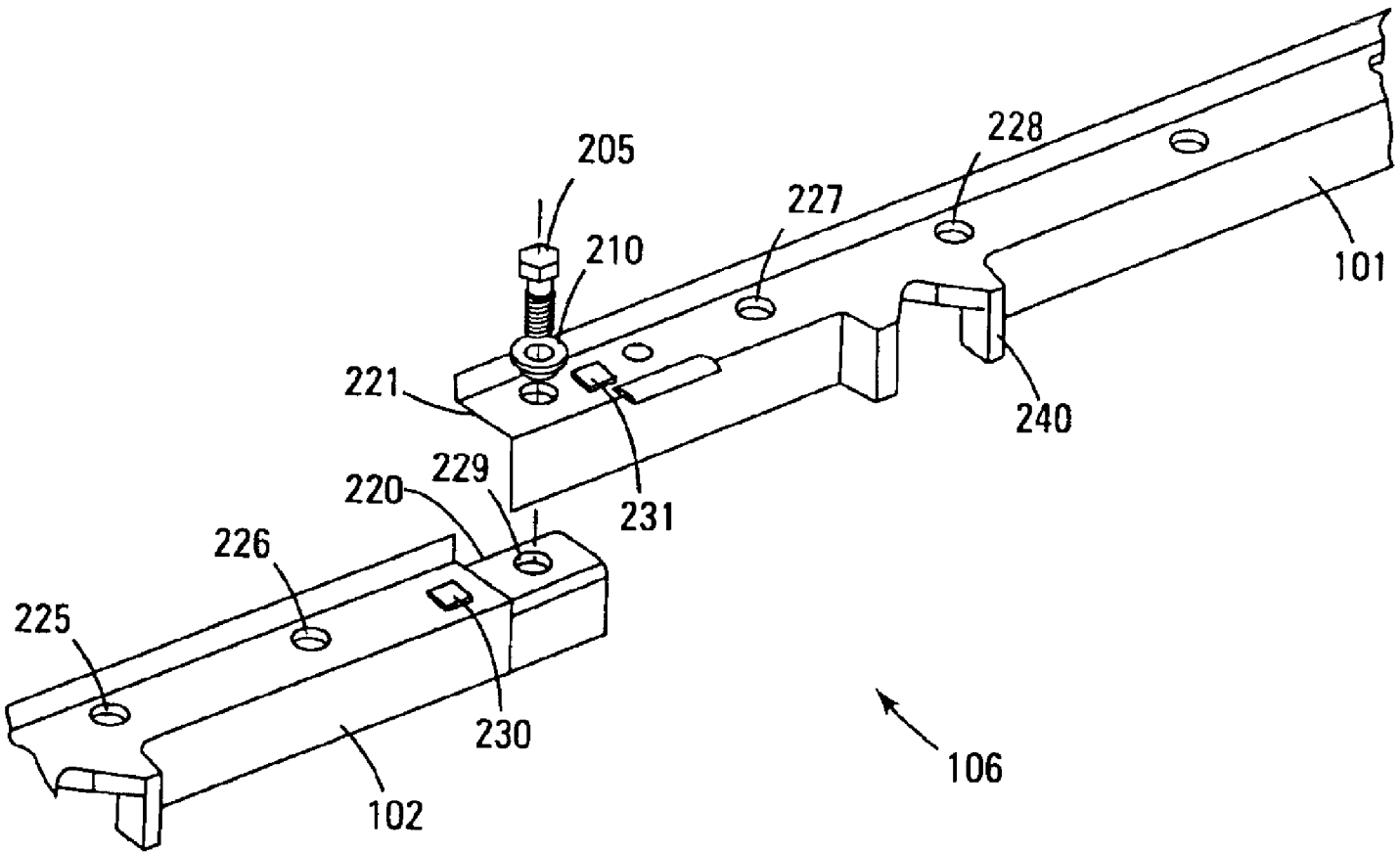
FIG. 2 shows a detailed view of one embodiment of the interconnection of the parts of the upper deck oil deflector apparatus in accordance with the embodiment of FIG. 1.

FIG. 2 illustrates a detailed view of one embodiment of the interconnection of two of the sections (101 and 102) of the upper deck oil deflector apparatus in accordance with the embodiment of FIG. 1. This detailed view shows the plurality of mounting holes (225–229) through which mounting bolts (205) or other types of fasteners are inserted. The ends (220 and 221) of each section (102 and 101) are approximately half as thick as the remaining portions of the section (101 or 102) so that when the two sections (101 and 102) are joined, the combined thickness is substantially uniform with the remainder of the sections.

In the embodiment of FIG. 2, the sections (101 and 102) are connected with a bolt (205), and a flanged spacer (210). When the oil deflector apparatus is mounted on an engine, the connecting bolt (205) is one of the plurality of bolts used to mount the apparatus to the engine. These bolts are inserted through the mounting holes (225–229) into threaded holes in the engine block. In one embodiment, the same bolts that mount the upper deck assembly to the engine block are used to mount the oil deflector apparatus over the gasket that is between the upper deck assembly and the engine block.

The mounting hole in the bottom section (102) that is joined to the upper section (101) is substantially the same size as the mounting hole in the upper section (101). A cross sectional view of this mounting detail is illustrated in FIG. 3 and described subsequently.

The embodiment of FIG. 2 also illustrates one of the layshaft support extensions (240). If these extensions are required, the shape, size, and position of the extensions (240) will vary depending on the engine.

As discussed previously, the different sections (101 and 102) of the deflector apparatus are not symmetrical. Therefore, each section must be joined to the appropriate end of another section. The assembly can be made more foolproof by the addition of symbols (230 and 231) on each end to be joined with another. In the embodiment of FIG. 2, these symbols are rectangles. In other words, when the rectangles are matched up, those ends are properly orientated. The other sections of FIG. 1 to be joined will have different symbols to differentiate them. For example, they may have circles indicating a proper orientation. Alternate embodiments may use other orientation symbols such as alphanumeric characters.

Figure 3:
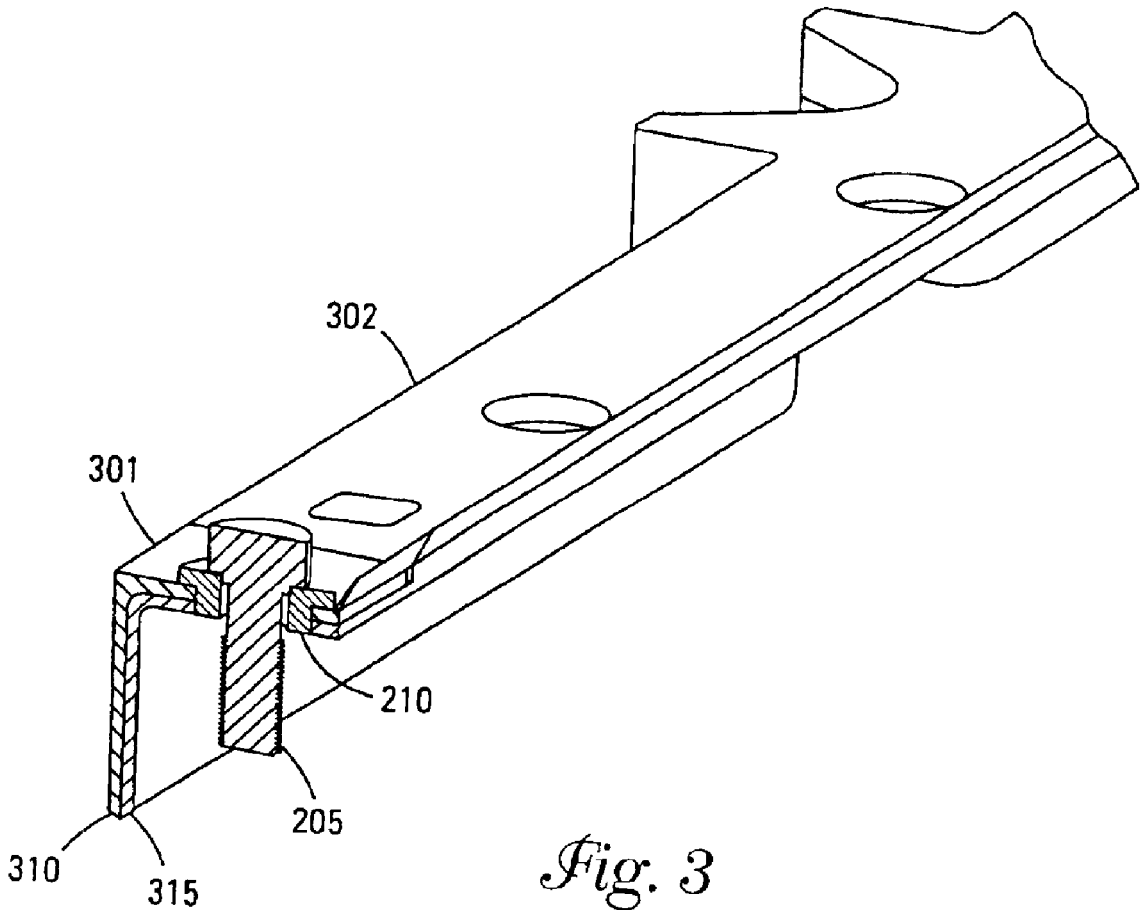
FIG. 3 shows a cross-sectional view of one embodiment of the interconnection parts of the upper deck oil deflector apparatus of the present invention.

FIG. 3 illustrates a cross-sectional view of one embodiment of the interconnection parts of the upper deck oil deflector apparatus of the present invention. This figure illustrates the same bolt (205) and flange-type spacer (210) as illustrated in FIG. 2.

FIG. 3 shows two sections (301 and 302) of the oil deflector apparatus being connected with the interconnection hardware (205 and 210). Each section has an end portion (310 and 315) that functions as an overlap joint when the sections are joined. These portions (310 and 315) are half as thick as the remainder of their respective sections (301 and 302) so that when they are joined together with the interconnection hardware (205 and 210) the completed assembly has the same thickness as the remainder of the oil deflector apparatus.

In one embodiment, the mounting hole in the upper section (301) is substantially the same size as the mounting hole in the lower section (302). This provides a mounting hole through which the one-piece flanged spacer (210) can be inserted prior to inserting the mounting bolt (205).

The remaining section oil deflection apparatus has similar mounting holes for connecting the remaining section to complete the apparatus and mount it to the engine. Alternate embodiments may use different size mounting holes in each section, depending on the mounting hardware used.

The bolt (205) is inserted into threaded mounting holes in the engine block in order to hold the oil deflector apparatus in place over the gasket. This mounting configuration is described subsequently.

Figure 4:
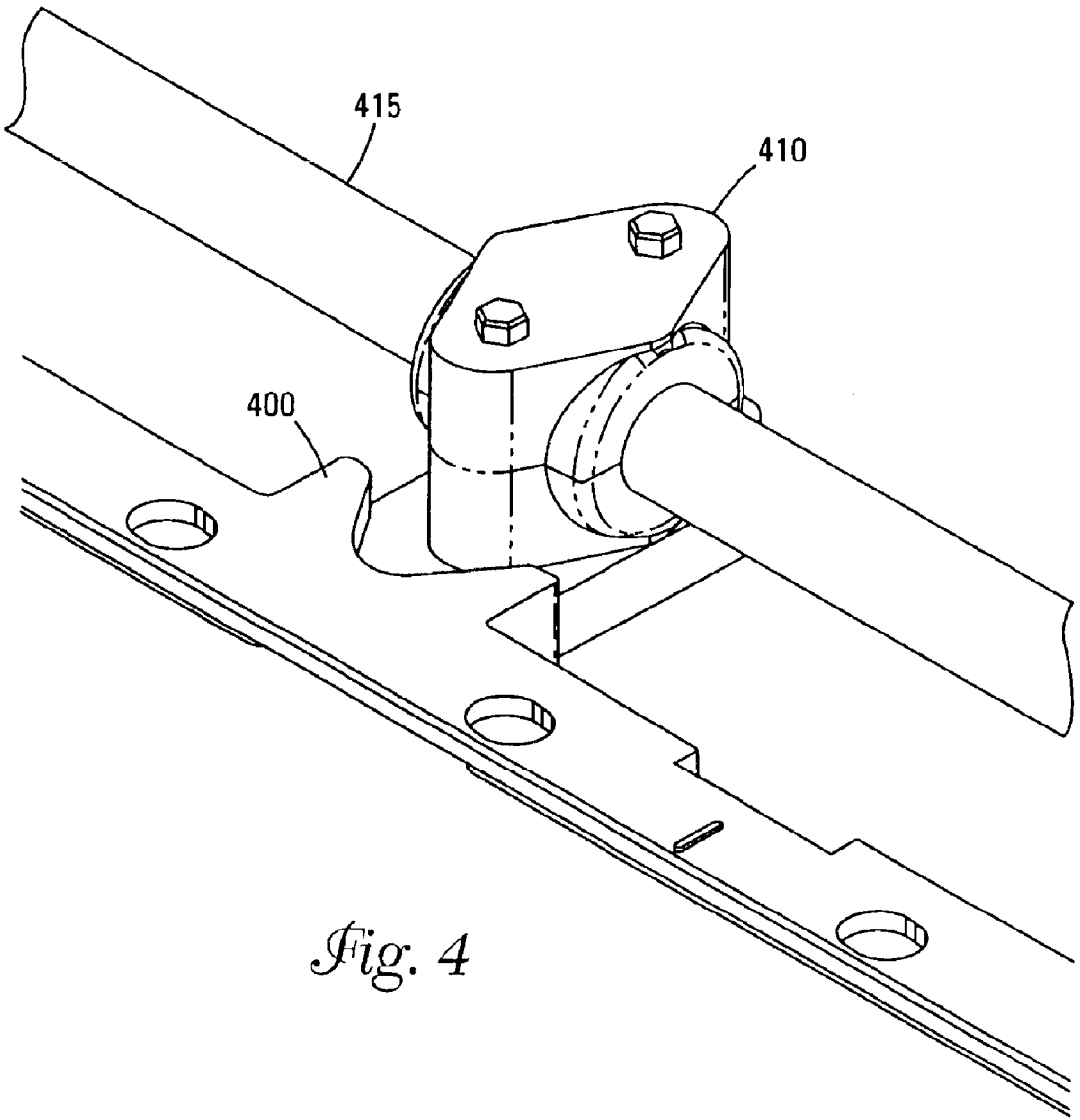
FIG. 4 shows a perspective view of one embodiment of the upper deck oil deflector apparatus of the present invention as installed around a layshaft support in an internal combustion engine.

FIG. 4 illustrates a perspective view of one embodiment of one section of the upper deck oil deflector apparatus of the present invention as installed around a layshaft support in an internal combustion engine. This view shows a layshaft support extension (400) that mounts around the layshaft support hardware (410) in the engine.

As is well known in the art, the layshaft support (410) contains a bearing through which the layshaft (415) rotates. Oil from this bearing can be splashed on the gasket. The layshaft support extension (400) prevents this oil from reaching the gasket as well as allowing the oil deflector apparatus to fit the length of the engine block around these supports.

Figure 5:
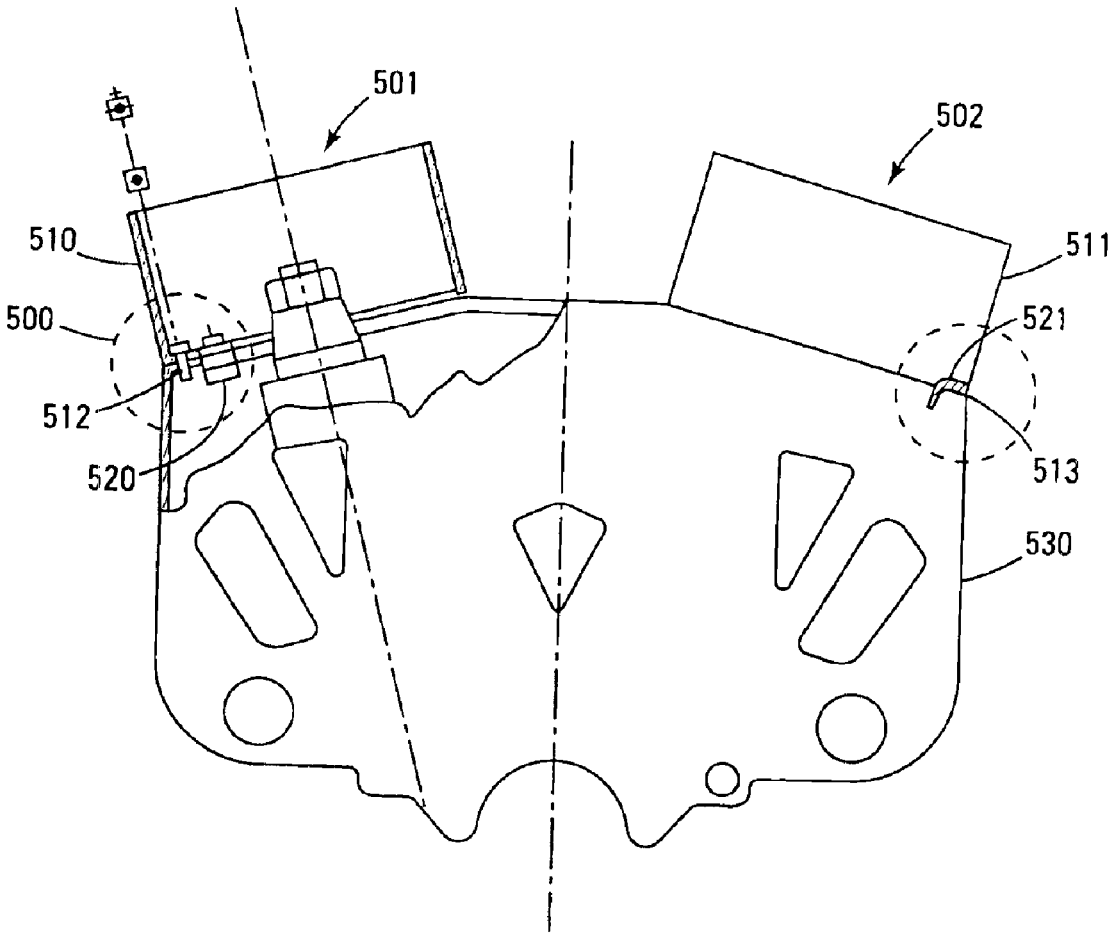
FIG. 5 shows a cross-sectional view of one embodiment of the upper deck oil deflection apparatus as installed in an internal combustion engine.

FIG. 5 illustrates a cross-sectional view of one embodiment of the upper deck oil deflection apparatus as installed in an internal combustion engine. This figure shows a typical internal combustion engine having an engine block (530) that contains the crankshaft, pistons, and other engine hardware. The embodiment of FIG. 5 is comprised of two banks of cylinder assemblies (501 and 502). Each cylinder assembly is covered with an upper deck (510 and 511). The gasket (512 and 513) to be protected is located between the upper deck (510 and 511) and the engine block (530).

In one embodiment, the oil deflector apparatus (520 and 521) of the present invention is mounted over the gaskets (512 and 513) on the outer sides of the engine block (530). These are the gaskets that receive the most oil contact from the internal splashing of oil. Alternate embodiments mount the oil deflector apparatus (520 and 521) over all of the gaskets between each upper deck (510 and 511) and the engine block (530).

As discussed above, due to the asymmetrical character of some engines, the oil deflector apparatus (520) that is mounted on one side of the engine block (530) will not fit on the other side of the engine block (530). This is due to the mounting holes and layshaft support hardware being in different locations on each side. In such an embodiment, the first oil deflector apparatus (520) is a mirror image of the second oil deflector apparatus (521). In alternate embodiments where the engine mounting holes and layshaft supports are symmetrically laid out, the same oil deflector apparatus can be used on either side of the engine. The area (500) of one of the oil deflector apparatuses (520) is illustrated in greater detail in FIG. 6.

Figure 6:
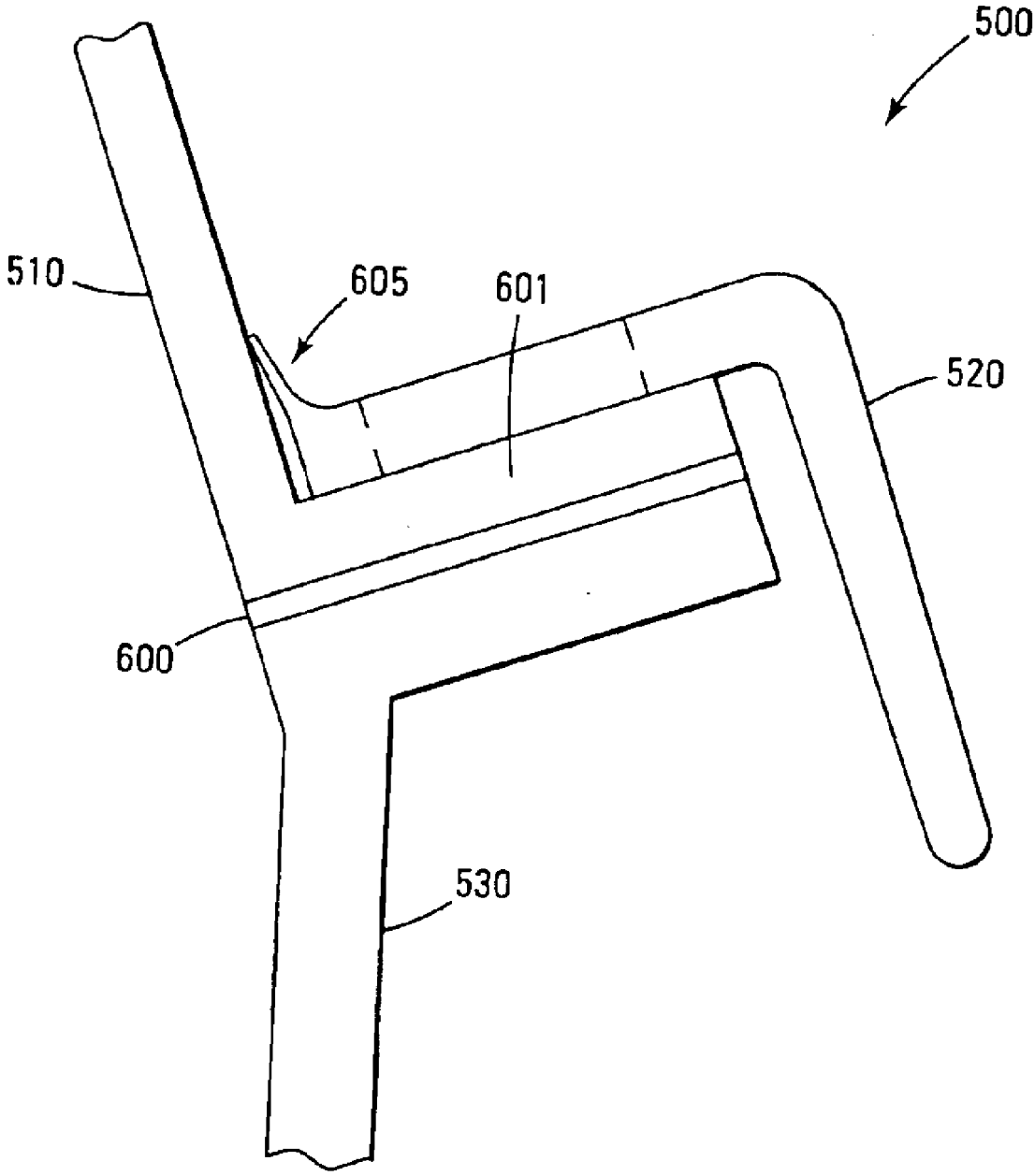
FIG. 6 shows a detailed view of one embodiment of the upper deck oil deflector apparatus of the present invention in accordance with the embodiment of FIG. 5.

FIG. 6 shows a cross sectional view of a portion of the left side upper deck assembly (510) mounted over the left portion of the engine block (530). The gasket (600) to be protected is mounted between them. The upper deck oil deflection apparatus (520) is mounted over the mounting surface (601) of the upper deck assembly (510). The same bolts that mount the upper deck assembly to the engine block (530) are used to mount the oil deflection apparatus (520).

A sealing lip (605) extends lengthwise along the sections of the apparatus (520) and projects upward to contact the upper deck assembly (510). The sealing lip provides extra protection against oil getting between the upper deck assembly (510) and the oil deflection apparatus (520).

Figure 7:
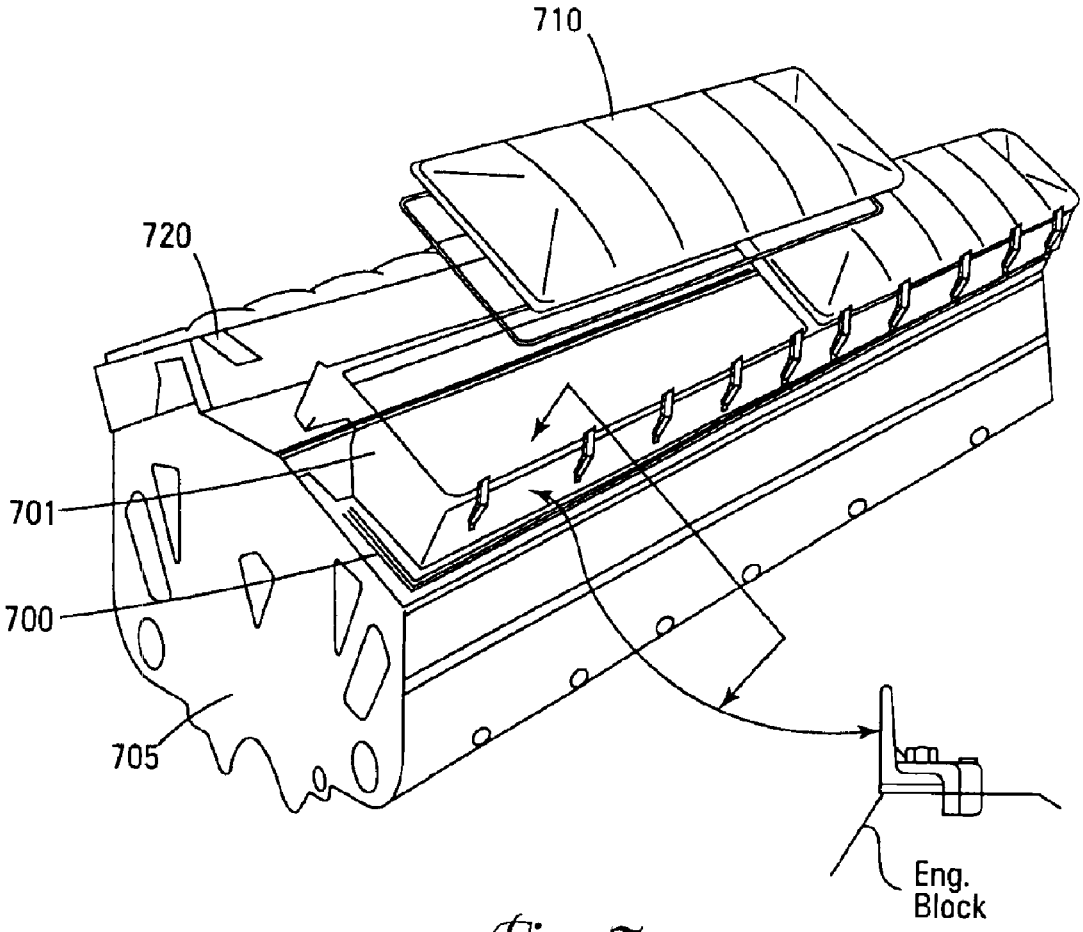
FIG. 7 shows a side perspective view of one embodiment of an internal combustion engine incorporating the upper deck oil deflection apparatus of the present invention.

FIG. 7 illustrates a right side perspective view of a typical internal combustion engine incorporating the upper deck oil deflection apparatus of the present invention. The upper deck assembly, in this embodiment, is comprised of the formed walls (701) with a cover (710) to enclose the cylinder assembly. The upper deck assembly (701 and 710) is then connected to the engine block (705) as described above. The oil deflection apparatus (700) is mounted lengthwise along the engine to cover the gasket. This is repeated for the second upper deck assembly on the other side of the engine.

The embodiment of FIG. 7 shows only the gaskets on the outer sides of the engine being protected by the oil deflector apparatus. In alternate embodiments, variations of the deflector apparatus can be mounted over any of the gaskets between the upper deck assembly and the engine block. To accomplish this, only the length, layout of the mounting holes, and locations of the layshaft extensions of the deflector apparatus need to be changed.

The embodiments described above mount the apparatus in the upper deck assembly of an internal combustion engine. However, the oil deflector apparatus of the present invention is not limited to only the upper deck assembly. Alternate embodiments could mount the oil deflector in any location in the engine in which it is desired to reduce oil contact.

In summary, the oil deflector apparatus of the present invention reduces oil leakage by deflecting oil away from the gasket. This reduces expensive maintenance required due to the oil leakage. The apparatus can be installed without any modifications to the existing engine other than mounting the apparatus over the gasket internal to the upper deck assembly.

Although specific embodiments have been illustrated and described herein, it will be appreciated by those of ordinary skill in the art that any arrangement that is calculated to achieve the same purpose may be substituted for the specific embodiments shown. Many adaptations of the invention will be apparent to those of ordinary skill in the art. Accordingly, this application is intended to cover any adaptations or variations of the invention. It is manifestly intended that this invention be limited only by the following claims and equivalents thereof.

What is claimed is:

1. An upper deck oil deflector apparatus in an internal combustion engine comprising an engine block, an upper deck assembly, and a gasket mounted between the engine block and the upper deck assembly, the apparatus comprising:

a first portion that is capable of extending lengthwise over a mounting surface of the upper deck assembly and the gasket, the first portion comprising mounting holes that correspond to mounting holes in the upper deck assembly and the engine block;

a second portion, coupled to and extending lengthwise along the first portion, the second portion coupled to the first portion at a downward angle such that an internal surface of the gasket is substantially covered; and a sealing lip that extends lengthwise along and protrudes upward from the first portion and contacts the upper deck assembly when the apparatus is installed.

2. The apparatus of claim 1 wherein the first and second portions of the apparatus are a single injection molded unit.

3. The apparatus of claim 1 wherein the angle is in a range from 0° to 180°.

4. The apparatus of claim 1 wherein the first and second portions are comprised of a plurality of sections that couple together at end portions.

5. The apparatus of claim 4 wherein the end portions have a thickness that is substantially half of a thickness of either the first or second portions such that when the plurality of sections are coupled together, the thickness of the apparatus is substantially uniform.

6. The apparatus of claim 1 and further including each end of the first and second portions of the apparatus having a bend that is substantially perpendicular to the lengthwise portions.

7. An upper deck oil deflector apparatus in an internal combustion engine comprising an engine block, an upper deck assembly, layshaft support hardware, and a gasket mounted between the engine block and the upper deck assembly, one surface of the gasket being internal to the engine, the apparatus comprising:

a first portion capable of extending lengthwise over a mounting surface of the upper deck assembly, the first portion comprising mounting holes that correspond to mounting holes in the upper deck assembly and the engine block;

a second portion, coupled to and extending lengthwise along the first portion, the second portion coupled to the first portion at an angle such that any internally exposed surfaces of the gasket are substantially covered; and layshaft support extensions located in a distributed manner lengthwise along the first and second portions in places where the apparatus would meet the layshaft support hardware, each extension extending up to the layshaft support hardware.

8. The apparatus of claim 7 wherein the mounting holes each comprise an area on a bottom surface of the first portion for accepting parts of mounting hardware.

9. The apparatus of claim 7 wherein the apparatus is comprised of a plurality of sections that are interconnected at ends having indicators for proper orientation of each section within the apparatus.

10. The apparatus of claim 9 wherein the first and second portions and the layshaft support extensions of each of the plurality of sections are an injection molded single unit.

11. The apparatus of claim 9 wherein each of the plurality of sections is comprised of injection molded urethane.

12. A method for producing an oil deflector apparatus, the method comprising:

injecting a material into a mold that comprises a substantially horizontal lengthwise portion and a substantially vertical lengthwise portion, the substantially horizontal lengthwise portion including mounting holes, both the substantially horizontal and vertical portions comprising extensions distributed along the length of the apparatus; the substantially horizontal lengthwise portion further having a lip portion extending lengthwise along and protruding upwards from the horizontal lengthwise portion; and removing the material from the mold after it has set.

13. An internal combustion engine comprising:

an engine block comprising a cylinder assembly and layshaft support hardware;

an upper deck assembly that covers the cylinder assembly;

a gasket coupled between a mounting surface of the upper deck assembly and the engine block, the gasket having at least one surface internal to the upper deck assembly; and an oil deflector apparatus comprising:

a first portion that is capable of extending over the gasket, the first portion having means for mounting to the engine block;

a second portion, coupled to and extending lengthwise along the first portion, the second portion extending downward at an angle to the first portion such that the internal surface of the gasket is substantially covered; and extensions distributed lengthwise along the first and second portions of the oil deflector apparatus that extend up to the layshaft support hardware.

* * * * *

UNITED STATES PATENT AND TRADEMARK OFFICE

CERTIFICATE OF CORRECTION

PATENT NO. : 6,912,985 B2
APPLICATION NO. : 10/652683
DATED : July 5, 2005
INVENTOR(S) : Gesell et al.

It is certified that error appears in the above-identified patent and that said Letters Patent is hereby corrected as shown below:

Title page:
(73) Assignee: delete "Micron Technology, Inc., Boise, ID (US)" and replace with --Miller Felpax Corporation, Winona, MN (US)--

Signed and Sealed this

Twenty-first Day of August, 2007

JON W. DUDAS
*Director of the United States Patent and Trademark Office*